US011384467B2

(12) United States Patent
Kessler et al.

(10) Patent No.: US 11,384,467 B2
(45) Date of Patent: Jul. 12, 2022

(54) DETECTION AND/OR MONITORING OF THE LOAD ON A TEXTILE PIECE DURING A TREATMENT CYCLE

(71) Applicant: Henkel AG & Co. KGaA, Duesseldorf (DE)

(72) Inventors: Arnd Kessler, Monheim am Rhein (DE); Christian Nitsch, Duesseldorf (DE); Lars Zuechner, Langenfeld (DE); Georg Wawer, Vienna (AT); Alexander Mueller, Monheim (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 649 days.

(21) Appl. No.: 16/318,096

(22) PCT Filed: Jul. 11, 2017

(86) PCT No.: PCT/EP2017/067350

§ 371 (c)(1),
(2) Date: Jan. 15, 2019

(87) PCT Pub. No.: WO2018/011183

PCT Pub. Date: Jan. 18, 2018

(65) Prior Publication Data

US 2021/0277566 A1 Sep. 9, 2021

(30) Foreign Application Priority Data

Jul. 15, 2016 (DE) ..... 10 2016 212 980.5

(51) Int. Cl.
*D06F 34/18* (2020.01)
*D06F 93/00* (2006.01)
(Continued)

(52) U.S. Cl.
CPC ..... *D06F 34/18* (2020.02); *D06F 93/00* (2013.01); *D06F 2103/02* (2020.02); *D06F 2103/06* (2020.02); *D06F 2103/08* (2020.02); *D06F 2103/12* (2020.02); *D06F 2103/26* (2020.02); *D06F 2103/38* (2020.02); *D06F 2103/64* (2020.02); *D06F 2105/58* (2020.02)

(58) Field of Classification Search
CPC ..... D06F 34/18
See application file for complete search history.

(56) References Cited

U.S. PATENT DOCUMENTS

| | | | | |
|---|---|---|---|---|
| 7,779,565 | B2 | 8/2010 | Jiang et al. | |
| 9,280,148 | B1 | 3/2016 | Colett et al. | |
| 10,184,210 | B1 * | 1/2019 | Volmut | G06Q 50/10 |

FOREIGN PATENT DOCUMENTS

| | | | |
|---|---|---|---|
| DE | 4309914 | A1 | 9/1994 |
| DE | 112005001253 | T5 | 4/2007 |

(Continued)

OTHER PUBLICATIONS

EPO, International Search Report and Written Opinion issued in International Application No. PCT/EP2017/067350, dated Sep. 12, 2017.

*Primary Examiner* — Spencer E. Bell
(74) *Attorney, Agent, or Firm* — Lorenz & Kopf, LLP

(57) ABSTRACT

The present disclosure relates to a method and to a textile piece device which allows storing and/or monitoring the load on a textile piece during one or more treatment cycles.

12 Claims, 5 Drawing Sheets

(51) Int. Cl.

| | |
|---|---|
| ***D06F 103/02*** | (2020.01) |
| ***D06F 103/12*** | (2020.01) |
| ***D06F 103/64*** | (2020.01) |
| ***D06F 105/58*** | (2020.01) |
| ***D06F 103/08*** | (2020.01) |
| *D06F 103/26* | (2020.01) |
| *D06F 103/38* | (2020.01) |
| *D06F 103/06* | (2020.01) |

(56) References Cited

FOREIGN PATENT DOCUMENTS

| | | | |
|---|---|---|---|
| DE | 102009023228 | A1 | 12/2010 |
| EP | 0548697 | A1 | 6/1993 |
| EP | 2568077 | A1 | 3/2013 |
| JP | H11-312224 | A | 11/1999 |
| KP | 1020090076722 | A | 7/2009 |
| WO | 2004055256 | A1 | 7/2004 |
| WO | 2007116330 | A2 | 10/2007 |

* cited by examiner

DETECTION AND/OR MONITORING OF THE LOAD ON A TEXTILE PIECE DURING A TREATMENT CYCLE

CROSS-REFERENCE TO RELATED APPLICATION

This application is a U.S. National-Stage entry under 35 U.S.C. § 371 based on International Application No. PCT/EP2017/067350, filed Jul. 11, 2017 which was published under PCT Article 21(2) and which claims priority to German Application No. 10 2016 212 980.5, filed Jul. 15, 2016, which are all hereby incorporated in their entirety by reference.

TECHNICAL FIELD

The present disclosure relates, inter alia, to a process and a textile piece device which enable storage and/or monitoring of the load on a textile piece during one or more treatment cycles.

BACKGROUND

A procedure for the administration of textiles or textile pieces is known from the international patent application WO04/055256. For this purpose, textile pieces are equipped with an identification device (e.g. RFID tag), which can in particular contain a unique identification code, information on the fiber type, dye, color and washing history. For reading out the information, for example, a sensor is provided at the opening of a washing machine, whereby a writing medium is also planned to write information on the identification medium. The information obtained can be used to compile a program for controlling a washing machine or a dosing device. However, this process is dependent on the washing machine having a corresponding sensor for reading the information.

With other state-of-the-art processes, the selection of the type (color, white, with bleach, with scent trap) and the dosage of the detergent as well as the selection and control of the washing program (temperature, duration, revolutions, etc.) are carried out manually. This is cumbersome and can lead to the selection of a washing program that is not permitted for one of the textile pieces, especially if several textile pieces are washed together.

In none of the known processes is the actual load on the textile pieces recorded and/or monitored.

BRIEF SUMMARY

Methods, textile piece devices, and textile pieces including a textile piece device for monitoring and/or detecting a load on the textile piece are provided herein. In an embodiment, a method includes, obtaining at a textile piece device for a textile piece, at least one treatment parameter value detected and/or determined by a sensor, the treatment parameter value being characteristic of a load on the textile piece during a treatment cycle. The method further includes storing the treatment parameter value in a memory of the textile piece device.

In another embodiment, a method includes receiving information from a textile piece device of a textile piece. The method further includes determining and/or adapting a treatment program for the textile piece at least partially depending on the received information from the textile piece device.

BRIEF DESCRIPTION OF THE DRAWINGS

The present disclosure will hereinafter be described in conjunction with the following drawing figures, wherein like numerals denote like elements, and wherein.

DETAILED DESCRIPTION

Figure 1A:
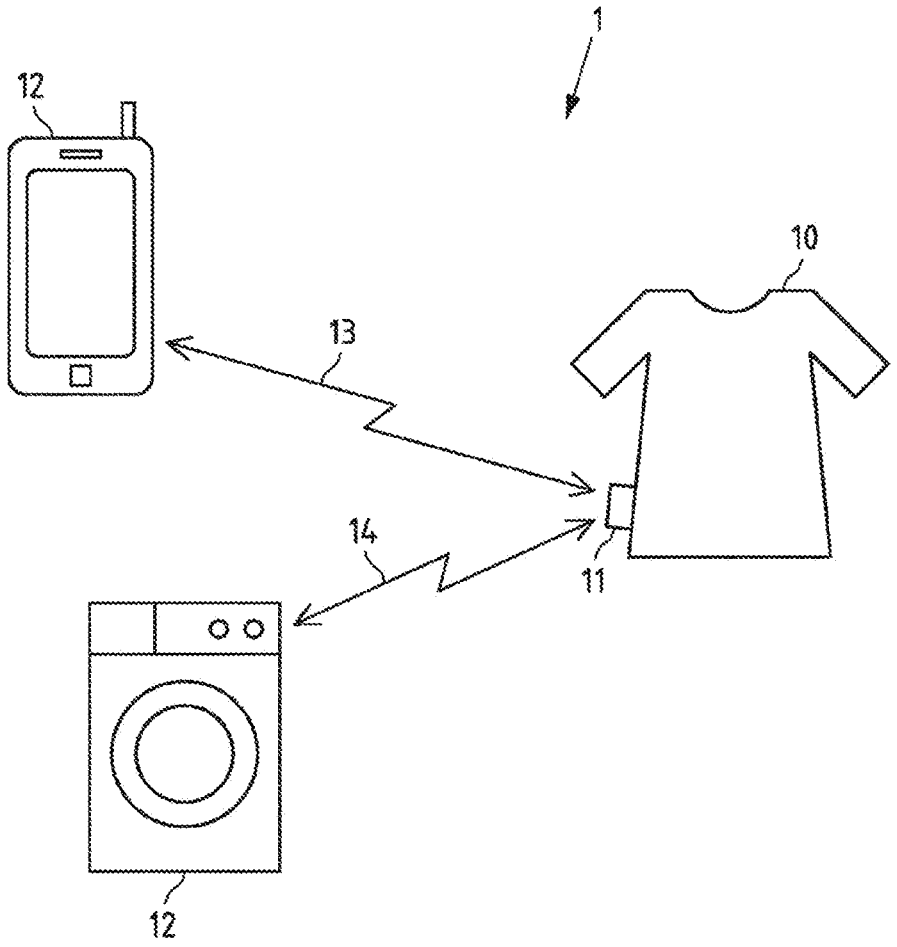
FIG. 1*a* is a schematic representation of an example of the execution of a system according to the third aspect of the present disclosure.

The following detailed description is merely exemplary in nature and is not intended to limit the disclosure or the application and uses of the subject matter as described herein. Furthermore, there is no intention to be bound by any theory presented in the preceding background or the following detailed description.

Against the background of the state of the art described above, it is therefore the task of the present disclosure to at least partially reduce or avoid the problems described, for example to make it possible to monitor the load on a textile piece during a treatment cycle.

According to a first aspect of the present disclosure, a procedure is disclosed, which includes the procedure:

Obtaining at a textile piece device for a textile piece, at least one treatment parameter value detected and/or determined by a sensor, the treatment parameter value being characteristic of a load on the textile piece during a treatment cycle, and Storing the treatment parameter value in a memory of the textile piece device of the textile piece.

The process according to the first aspect of the present disclosure is, for example, a process for storing and/or monitoring the load on a textile piece during one or more treatment cycles.

According to the first aspect of the present disclosure, a textile piece device is further disclosed for a textile piece, wherein the textile piece device being arranged to perform and/or control the process in accordance with the first aspect of the present disclosure or comprising respective features for performing and/or controlling the steps of the process in accordance with the first aspect of the present disclosure.

Either all steps of the procedure can be controlled by the features, or all steps of the procedure can be executed by the features, or one or more steps can be controlled by the features and one or more steps can be executed by the features. Different steps can optionally be performed or controlled by different features.

For example, the textile piece device comprises at least one processor and at least one memory with program instructions of a computer program (e.g. the computer program according to the first aspect of the present disclosure). A processor is for example intended to be understood to be a control unit, a microprocessor, a microcontrol unit such as a microcontroller, a digital signal processor (DSP), an application-specific integrated circuit (ASIC) or a field programmable gate array (FPGA).

Alternatively or additionally, the textile piece device comprises at least one sensor arranged to detect and/or determine a value of a washing parameter before and/or during a washing cycle of the textile piece.

According to the first aspect of the present disclosure, a textile piece is also revealed, wherein the textile piece comprises a textile piece device according to the first aspect of the present disclosure. For example, the textile piece device is located on and/or in a label of the textile piece.

In accordance with the first aspect of the present disclosure, a computer program is further disclosed, the computer program comprising program instructions that cause a processor to execute and/or control the process in accordance with the first aspect of the present disclosure when the computer program runs on the processor. An exemplary program according to the first aspect of the present disclosure may be stored in or on a computer-readable storage medium containing one or more programs.

According to the first aspect of the present disclosure, a computer-readable storage medium containing a computer program according to the first aspect is also disclosed. A computer-readable memory medium may be designed e.g. as a magnetic, electrical, electromagnetic, optical and/or different memory medium. Such a computer-readable memory medium of this type is preferably a physical object (i.e. "tangible"); for example it is designed as a data carrier device. A data carrier device is for example portable or permanently installed in a device. Examples of a data carrier device of this type are volatile or non-volatile memories with random access (RAM), such as NOR flash memories, or with sequential access, such as NAND flash memories, and/or memories with read-only access (ROM) or read/write access. Computer-readable is for example intended to be understood to mean that the memory medium can be read and/or written by a computer or a data-processing system, for example by a processor.

In the following, further exemplary properties and designs of the textile piece device, the textile piece of the process and the computer program according to the first aspect of the present disclosure are described.

A textile piece, for example, is an article that is made from at least about 80% of its weight of textile raw materials. Textile raw materials are to be understood as, for example, fibers including animal hair that can be spun or processed into textile fabrics.

The textile item is, for example, a piece of laundry, in particular a piece of clothing. Other examples of textile pieces are curtains, towels, bed linen, tablecloths or cleaning cloths.

The fact that the textile piece device is for a textile piece is to be understood, for example, as meaning that the textile piece device is designed in such a way that it remains functional even during a treatment cycle of the textile piece. For example, the textile piece device is designed in such a way that it can withstand the usual loads in a washing machine during a washing programme or in a dryer during a drying programme without being damaged. For example, the textile piece device is watertight (e.g. watertight up to a pressure of from about 5 to about 10 bar, preferably watertight up to a pressure of from about 10 to about 20 bar).

For example, the textile piece device can be placed and/or arranged on and/or in a label of the textile piece.

A treatment cycle of the textile piece is understood, for example, as washing the textile piece by hand or in a washing machine. Furthermore, a subsequent drying of the textile piece in the air or in a dryer can also be understood as part of the treatment cycle. Washing in the washing machine can, for example, be done according to a washing program of the washing machine, and drying in the dryer can, for example, be done according to a dryer program of the dryer.

The treatment parameter value detected and/or determined by the sensor represents, for example, a value of a treatment parameter characteristic of the load on the textile piece during treatment of the textile piece. The treatment parameter value detected and/or determined by the sensor represents, for example, a value of a treatment parameter characteristic of the load on the textile piece during treatment of the textile piece. The load on the textile piece during washing in a washing machine depends, for example, on the washing program (e.g. washing temperature, washing time, water level, spin speed, etc.), the detergent and its dosage, the loading of the washing drum and the other textile pieces. Excessive stress on the textile piece can, for example, lead to damage, heavy wear and ageing and/or unwanted discoloration of the textile piece.

According to an exemplary design of the first aspect of the present disclosure, the procedure also includes the entry and/or determination of the treatment parameter value.

For example, the measured and/or determined value of the washing parameter represents a value of a magnitude characteristic of the loading of the textile piece during the treatment cycle. Accordingly, the term treatment parameter value should be understood to mean, for example, that a value of a characteristic value for the load on the textile piece during the treatment cycle is measured. Under determining a treatment parameter value, for example, it should be understood that the treatment parameter value is determined (e.g. calculated) based on one or more measured values of one or more variables.

For example, the treatment parameter value is recorded and/or determined before and/or during treatment. This should be understood, for example, to mean that the treatment parameter value is recorded when the textile piece is in a washing machine and/or dryer. For example, the washing machine or dryer causes the sensor to detect and/or determine the treatment parameter value before and/or during the treatment cycle (e.g. a washing program and/or dryer program).

For example, further treatment parameter values of at least some different treatment cycles are stored in the memory of the textile piece device. By storing several treatment parameter values of different treatment cycles of the textile piece, for example, a treatment cycle history (e.g. a washing history) of the textile piece can be obtained. This is advantageous, for example, in order to draw conclusions about the age of the textile piece, the treatment frequency of the textile piece and/or the load on the textile piece during the different treatment cycles.

According to an exemplary design of the first aspect of the present disclosure, the sensor by which the treatment parameter value is detected and/or determined is part of the textile piece device. In this case, the maintenance of the treatment parameter on the textile piece device is to be understood, for example, as meaning that the treatment parameter is detected and/or determined by the sensor of the textile piece device. For example, the textile piece device sensor is set up to detect and/or determine the treatment parameter value as soon as the textile piece device is activated. For example, the textile cutting device can be activated manually and/or by the washing machine or dryer.

According to an exemplary design of the first aspect of the present disclosure, the sensor by which the treatment parameter value is detected and/or determined is part of a device (e.g., a washing machine and/or a dryer) other than the textile piece device. In this case, obtaining the treatment parameter at the textile piece device, for example, that the treatment parameter value or information comprising the treatment parameter value is received by a communication interface of the textile piece device (e.g. received by the sensor or the device comprising the sensor).

According to an exemplary design of the first aspect of the present disclosure, several treatment parameter values are obtained at the textile piece device. For example, at least one treatment parameter value is detected and/or determined by a sensor which is part of the textile piece device, and at least one further treatment parameter value is detected and/or determined by a sensor which is part of a device other than the textile piece device.

According to an exemplary design of the first aspect of the present disclosure, the treatment parameter value is indicative of temperature, treatment duration, acceleration, pressure, vibration, electromagnetic field, electromagnetic radiation (e.g. visible or invisible electromagnetic radiation), a sound frequency, a sound pressure level, a pH value, a conductivity, a redox potential, an odor, an ozone concentration, a NOX concentration, an SO2-concentration, a color, a white fraction, a germ load, a location, a humidity, an air pressure, a wind speed, a wind direction, a light intensity, a Rayleigh scattering and/or a dust concentration.

Each of these parameters, for example, is characteristic of a load on the textile piece during a treatment cycle.

For example, an impermissibly high temperature of the washing liquor in the vicinity of the textile piece can promote bleaching of the textile piece, so that the color of the textile piece fades and other simultaneously washed textile pieces are discolored. The ambient temperature is therefore a characteristic parameter for the exposure of a colored textile piece during washing during a treatment cycle. For example, the ambient temperature of the textile piece is measured and/or determined. For this purpose, the textile piece device comprises, for example, a temperature sensor (e.g. a Pt100 measuring resistor and/or a semiconductor temperature sensor). Alternatively or additionally it is also conceivable that the washing machine or dryer includes an appropriate temperature sensor.

The acceleration of the textile piece and/or the pressure acting on the textile piece, for example, are characteristic for a mechanical load on the textile piece during spinning during a treatment cycle. An impermissible acceleration and/or an impermissible pressure can lead to damage of the textile piece. The acceleration acting on the textile piece and/or the textile piece device can, for example, be detected and/or determined by an acceleration sensor of the textile piece device. An acceleration sensor, for example, can be a micro-electro-mechanical system (MEMS) based on the spring-mass principle, in which acceleration can be indirectly determined by a change in capacitance. The pressure can be detected and/or determined by a pressure sensor (e.g. a capacitive pressure sensor) of the textile piece device. Alternatively or additionally, it is also conceivable that the washing machine or the dryer comprises a corresponding acceleration sensor and/or a corresponding pressure sensor.

The color of the wash liquor and/or other textile pieces in the vicinity of the textile piece and/or the textile piece device may also be characteristic of a load on the textile piece during the treatment cycle. Thus, discoloration of the wash liquor and/or different colors in the vicinity of the textile piece and/or the textile piece device may indicate a risk of discoloration of the textile piece. Alternatively or additionally, the contrast and/or white content in the environment of the textile piece and/or the textile piece device may also be characteristic of such loading of the textile piece during the treatment cycle. Accordingly, the sensor by which the treatment parameter value is detected and/or determined may be, for example, an optical sensor for detecting and/or determining color, white content and/or contrast. For example, such an optical sensor comprises at least one photodiode and optionally a light-emitting diode. Alternatively or additionally, the optical sensor is for example an image sensor such as a CCD sensor and/or a CMOS sensor.

An electromagnetic radiation (e.g. visible or invisible electromagnetic radiation) or a light intensity can be characteristic for a load of the textile piece during drying and during the treatment cycle. For example, strong sunlight can lead to bleaching of a colored textile piece. Such electromagnetic radiation or light intensity can also be detected by an optical sensor. For example, the optical sensor comprises a spectrometer (e.g. a UV/VIS spectrometer). For example, the optical sensor is designed to detect visible or invisible electromagnetic radiation. For example, the optical sensor is designed to detect UV radiation, such as UV-A, UV-B and/or UV-C radiation. For example, the sensor is designed to detect infrared radiation such as NIR, MIR and/or FIR radiation.

Other variables characteristic of the load on the textile piece are, for example, a pH value, conductivity and/or redox potential of the washing liquor. These parameters depend, for example, on the water hardness and/or the chemical composition of the wash liquor and/or detergent and/or a dosage of detergent during washing during the treatment cycle. An inadmissible dosage and/or chemical composition of the detergent may, for example, result in damage, bleaching and/or discoloration of the textile piece. Also an inadmissible water hardness can be harmful for the textile piece. To measure and/or determine these variables, the sensor can be a chemical sensor (e.g. an ion-selective electrode) such as a pH value sensor (e.g. a pH electrode), a redox potential sensor and/or a conductivity sensor.

The duration of the treatment cycle and/or a section of the treatment cycle may also be characteristic of loading of the textile piece during the treatment cycle. For example, the textile piece may only be subjected to high acceleration for a short period, but to lower acceleration for a longer period. The duration of the treatment cycle and/or of a section of the treatment cycle can, for example, be recorded and/or determined by a timer.

According to an exemplary design of the first aspect of the present disclosure, the process also includes wireless communication with a device different from the textile piece device.

For example, the device different from the textile piece device is a washing machine and/or a dryer (e.g. a household washing machine for textiles and/or a household dryer for textiles), for example a washing machine and/or a dryer, in which the textile piece device and/or the textile piece for washing and/or drying is located. Furthermore, the device different from the textile piece device may also be another textile piece device and/or a mobile user device such as a smartphone, a tablet computer and/or a laptop computer. The device different from the textile piece device is, for example, a device according to the second aspect of the present disclosure.

Wireless communication includes, for example, sending and/or receiving information over a wireless communication link. For example, one or more pieces of information are sent via such a wireless communication link to the device other than the textile piece device and/or one or more pieces of information are received from that device via such a wireless communication link.

The wireless communication, for example, can be based on wireless radio communication technology. An example of wireless radio communication technology is Radio Frequency Identification (RFID) and/or Near Field Communication (NFC) and/or Bluetooth (e.g. Bluetooth version 2.1 and/or 4.0) and/or Wireless Local Area Network (WLAN). For example, RFID and NFC are specified in accordance with ISO standards 18000, 11784/11785 and ISO/IEC standards 14443-A and 15693. The Bluetooth specifications are available at www.bluetooth.org. WLAN, for example, is specified in the standards of the IEEE 802.11 family.

For example, the textile piece device includes a wireless communication interface configured to communicate with a device other than the textile piece device via a wireless communication link. For example, the wireless communication interface includes a transmitter, a receiver and/or a transceiver. Alternatively or additionally, the wireless communication interface includes one or more antennas. The wireless communication interface is, for example, a Bluetooth interface, a WLAN interface, an NFC interface and/or an RFID interface.

In accordance with an exemplary design of the first aspect of the present disclosure, sending (e.g. sending via a wireless communication link) a textile piece treatment information from the textile piece device to a device different from the textile piece device, wherein the textile piece treatment information is indicative of an allowable treatment parameter value and/or an allowable treatment parameter value range for the textile piece.

By sending the treatment parameter information from the textile piece device to the different devices from the textile piece device, this device is enabled, for example, to analyze and/or monitor the load on the textile piece. For example, the other device can determine the condition of the textile piece on the basis of a treatment cycle history of the textile piece and/or determine whether the treatment parameter value for the textile piece is admissible (e.g. at least partially dependent on textile piece treatment information also received from the textile piece device). As revealed above, different devices from the textile piece device are, for example, a washing machine and/or a dryer. Furthermore, the device different from the textile piece device may also be a user device.

In accordance with an exemplary design of execution of the first aspect of the present disclosure, the process further comprises sending (e.g., sending via a wireless communication link) textile piece treatment information from the textile piece device to an apparatus other than the textile piece device, the textile piece treatment information representing an allowable treatment parameter value and/or an allowable treatment parameter value range for the textile piece.

The textile piece washing information, for example, is stored in a memory of the textile piece device. For example, several textile pieces washing information are stored in a memory of the textile piece device.

For example, textile piece treatment information should be understood as treatment information for the textile piece. Such treatment information may, for example, represent a permissible treatment parameter value (e.g. minimum or maximum) and/or a permissible treatment parameter value range for the textile piece, with which the textile piece may be permanently loaded under practical conditions or for a certain duration during a treatment cycle without damaging the textile. For example, several textile pieces treatment information can represent a care instruction for the textile piece. This is advantageous, for example, in order to determine a washing programme and/or a drying programme permitted for the textile piece (e.g. a washing and/or drying programme in which the values and/or ranges permitted for the textile piece of one or more washing parameters are not exceeded) and/or to prevent an impermissible washing programme and/or an impermissible drying programme from being started.

In accordance with an exemplary form of the first aspect of the present disclosure, the process also includes determining whether the treatment parameter value detected and/or determined by the sensor is admissible for the textile piece. For example, this determination is carried out by the textile piece device. However, it is also conceivable that the determination is made by a device different from the textile piece device based on information received from the textile piece device.

Determining whether the specific treatment parameter value for the textile piece is permissible may be at least partially dependent on textile piece treatment information stored in a memory of the textile piece device. As disclosed above, such textile piece treatment information may represent a permissible treatment parameter range for the textile piece, with which the textile piece may be permanently loaded under practical conditions or for a certain period during a treatment cycle without damaging the textile. If the detected and/or determined treatment parameter value is impermissible (e.g. outside an admissible treatment parameter value range) according to textile treatment information stored in a memory of the textile piece device, the result of determining, for example, that the treatment parameter value is impermissible for the textile piece is impermissible. This is advantageous, for example, in order to be able to monitor the load on the textile piece.

In accordance with an exemplary design of the first aspect of the present disclosure, the process further comprises inducing a change in treatment of the textile piece and/or notification of a user if determining that the treatment parameter value for the textile piece is invalid.

In accordance with an exemplary design of the first aspect of the present disclosure, sending (e.g. sending via a wireless communication link) a textile piece treatment information from the textile piece device to a device different from the textile piece device, wherein the textile piece treatment information is indicative of an allowable treatment parameter value and/or an allowable treatment parameter value range for the textile piece. As revealed above, the device different from the textile piece device is, for example, a washing machine and/or a dryer. Furthermore, the device different from the textile piece device may also be a user device.

If the device different from the textile piece device is a washing machine or dryer, for example, the treatment parameter change information causes the washing machine or dryer, for example, to adjust or interrupt a running washing and/or drying program so that the treatment parameter value changes subsequently (e.g. the treatment parameter value is changed to an allowable value). For example, the treatment parameter change information may cause a change in the washing temperature, spin speed, water level of a washing program of the washing machine and/or dryer temperature of a dryer program of the dryer.

Alternatively or additionally, if the device other than the textile piece device is a user device, the treatment parameter change information may, for example, cause a user to be notified by the user device to a user in order to alert the user to the invalid treatment parameter value and/or cause the user to manually change the value. The notification can, for example, be a text notification on a screen of the user device and/or an acoustic notification of the user (for example, by a warning tone). This is advantageous, for example, if there is no communication between the textile piece device and the washing machine and/or dryer.

According to an exemplary design of implementation of the first aspect of the present disclosure, the procedure also includes the negotiation of a ranking and/or prioritization with one or more other textile piece devices. For example, the textile piece devices form an autonomous mesh network and negotiate a ranking and/or prioritization of the textile piece devices and/or various textile piece treatment information, washing parameter information and/or washing parameter change information. Negotiation can take place, for example, by exchanging appropriate information via the mesh network. For example, negotiation is based on a priority list. Alternatively or additionally, information that is permitted for all textile pieces, for example, is prioritized during negotiation. For example, only prioritized textile piece devices may communicate with a washing machine, dryer and/or user equipment and/or only prioritized information may be communicated to a washing machine, dryer and/or user equipment. This is advantageous, for example, to prevent the washing machine, dryer and/or user equipment from receiving conflicting information from different textile piece devices.

Alternatively or additionally, a textile piece device can be specified which is to be prioritized (e.g. by the device according to the second aspect of the present disclosure and/or a user). For example, the corresponding information is received at the textile cutting devices.

According to an exemplary design of the first aspect of the present disclosure, the textile piece device is arranged, for example, to receive energy wirelessly for operating the textile piece device and/or for charging an energy storage medium (e.g. a battery, an accumulator and/or a capacitor) of the textile piece device. Standards for wireless power transmission are for example the standard developed by the Airfuel Alliance (www.airfuel.org) or the so-called Qi standard developed by the Wireless Power Consortium (www.wirelesspowerconsortium.com). For example, the textile cutting device is set up to receive energy according to one of these wireless energy transmission standards. Passive RFID transponders are another example of wireless energy transmission. For example, the textile piece device is designed as such a passive RFID transponder.

For example, a textile piece device sensor is set up to detect and/or determine the value of the washing parameter only when it receives power to operate the textile piece device of the textile piece device wirelessly. For example, the textile cutting device is only activated when it receives energy to operate the textile cutting device of the textile cutting device wirelessly.

For example, the energy from a washing machine and/or dryer can be transferred wirelessly to the textile cutting device, for example, the washing machine and/or dryer generates a corresponding energy transfer field in at least part of the washing drum and/or dryer drum. This is advantageous, for example, in order to ensure an energy supply of the textile piece device at least partially during the treatment cycle.

According to a second aspect of the present disclosure, a procedure is disclosed, which includes the procedure:

Receiving information from a textile piece device for a textile piece,

Determining and/or adapting a program for a washing cycle for the textile piece at least partially depending on the information received.

According to the second aspect of the present disclosure, a device is further disclosed, wherein the device is arranged to execute and/or control the process according to the second aspect of the present disclosure or comprises respective features for executing and/or control the steps of the process according to the second aspect of the present disclosure. For example, the device is a washing machine and/or a dryer (e.g. a household washing machine for textiles and/or a household dryer for textiles) or a part of a washing machine and/or a dryer. Alternatively, the device may be a mobile user device such as a smartphone, tablet computer and/or laptop computer.

Either all steps of the procedure can be controlled by the features, or all steps of the procedure can be executed by the features, or one or more steps can be controlled by the features and one or more steps can be executed by the features.

Different steps can optionally be performed or controlled by different features.

For example, the device comprises at least one processor and at least one memory containing program instructions of a computer program (e.g. the computer program according to the first aspect of the present disclosure).

In accordance with the second aspect of the present disclosure, a computer program is further disclosed, the computer program comprising program instructions that cause a processor to execute and/or control the process in accordance with the second aspect of the present disclosure when the computer program runs on the processor. An exemplary program according to the second aspect of the present disclosure may be stored in or on a computer-readable storage medium containing one or more programs.

According to the second aspect of the present disclosure, a computer-readable storage medium containing a computer program according to the second aspect is also disclosed.

In the following, further exemplary characteristics and designs of execution of the procedure, the device and the computer program are revealed according to the second aspect of the present disclosure.

The textile piece device from which the information is received is, for example, a textile piece device according to the first aspect of the present disclosure. Accordingly, the information received corresponds to one of the information revealed above in connection with the first aspect of the present disclosure, which is sent from the textile piece device to another device. For example, the received information is and/or comprises washing parameter information representing a value of a washing parameter detected and/or determined before and/or during the washing cycle of the textile piece, and/or textile piece treatment information representing an allowable value and/or range of values of the washing parameter for the textile piece, and/or washing parameter change information.

The determination and/or adaptation of a program for a washing cycle for the textile piece is intended, for example, to mean that a permissible washing and/or drying program for the textile piece is determined (e.g. a washing and/or drying program in which the values and/or value ranges of one or more washing parameters permissible for the textile piece are not exceeded) and/or a washing and/or drying program for the textile piece is adapted (e.g. is adapted in such a way that an impermissible value of a washing parameter changes into a permissible value).

Following an exemplary form of the second aspect of the present disclosure, the process also includes wireless communication with the textile piece device. As disclosed above, wireless communication includes, for example, sending and/or receiving information over a wireless communication link. For example, information is received from the textile cutting device via such a wireless communication link. Furthermore, one or more pieces of information can be sent to the textile piece device via such a wireless communication link.

The wireless communication, for example, can be based on wireless radio communication technology. An example of wireless radio communication technology is Radio Frequency Identification (RFID) and/or Near Field Communication (NFC) and/or Bluetooth (e.g. Bluetooth version 2.1 and/or 4.0) and/or Wireless Local Area Network (WLAN).

For example, according to the second aspect of the present disclosure, the device comprises a wireless communication interface arranged to communicate with the textile piece device via a wireless communication link. For example, the wireless communication interface includes a transmitter, a receiver and/or a transceiver. Alternatively or additionally, the wireless communication interface includes one or more antennas. The wireless communication interface is, for example, a Bluetooth interface, a WLAN interface, an NFC interface and/or an RFID interface.

As revealed above, according to the second aspect of the present disclosure, the device can, for example, specify which textile piece device is to be prioritized by several different textile piece devices. This specification can, for example, be made automatically (e.g. depending on the information received from the textile piece devices) or based on a user input. Then the corresponding information is sent to the various textile cutting devices.

According to a third aspect of the present disclosure, a system is revealed, whereby the system comprises:

- a textile piece device according to the first aspect of the present disclosure, and
- a device according to the second aspect of the present disclosure.

The exemplary designs of execution of the present disclosure described above in this description should also be understood in all combinations with each other. The exemplary designs of execution of the present disclosure described above in this description should also be understood in all combinations with each other.

In particular, by way of the preceding or following description of process steps according to preferred designs of a process, corresponding features for carrying out the process steps are also intended to be disclosed by preferred designs of a device. Likewise, the disclosure of employing a device for carrying out a process step is also intended to disclose the corresponding method step.

Further advantageous designs of execution of the present disclosure are to be taken from the following detailed description of some examples of execution of the present disclosure, in particular in connection with the figures. The drawings are however only provided for illustrative purposes, and do not serve to define the scope of protection of the present disclosure. The drawings are not to scale and are merely intended to provide an example of the general concept of the present disclosure. In particular, features contained in the drawings are not in any way intended to be considered as necessary components of the present disclosure.

FIG. 1*a* shows an exemplary system 1 according to the third aspect of the present disclosure. System 1 comprises a textile piece 10, on the label of which a textile piece device 11 is arranged. Textile piece device 11 is a textile piece device according to the first aspect of the present disclosure. System 1 also includes a device 12. FIG. 1*a* shows several designs of the device 12. For example, the device 12 may be a washing machine (e.g. a household washing machine for textiles) or part of a washing machine. Alternatively, the device 12 can be a smartphone or part of a smartphone, for example.

The textile cutting device 11 and device 12 may have wireless communication interfaces to communicate wirelessly with each other. This is indicated in FIG. 1*a* by the exemplary wireless communication links 13 and 14.

For the loading of the textile piece 10 in a washing cycle the most different parameters are responsible like for example:

a. Washing temperature
b. Washing time
c. Washing agent
d. Washing mechanism

Together, these factors result in a load on the textile piece 10 due to a washing or drying process of the washing cycle. Through the textile piece device 11, with which the textile piece 10 is provided, at least one value of a washing parameter critical for the textile piece can be measured and action strategies derived from the measured values. Furthermore, the textile piece device can store 11 properties of the textile piece in terms of composition, color, type of fabric.

Figure 1B:
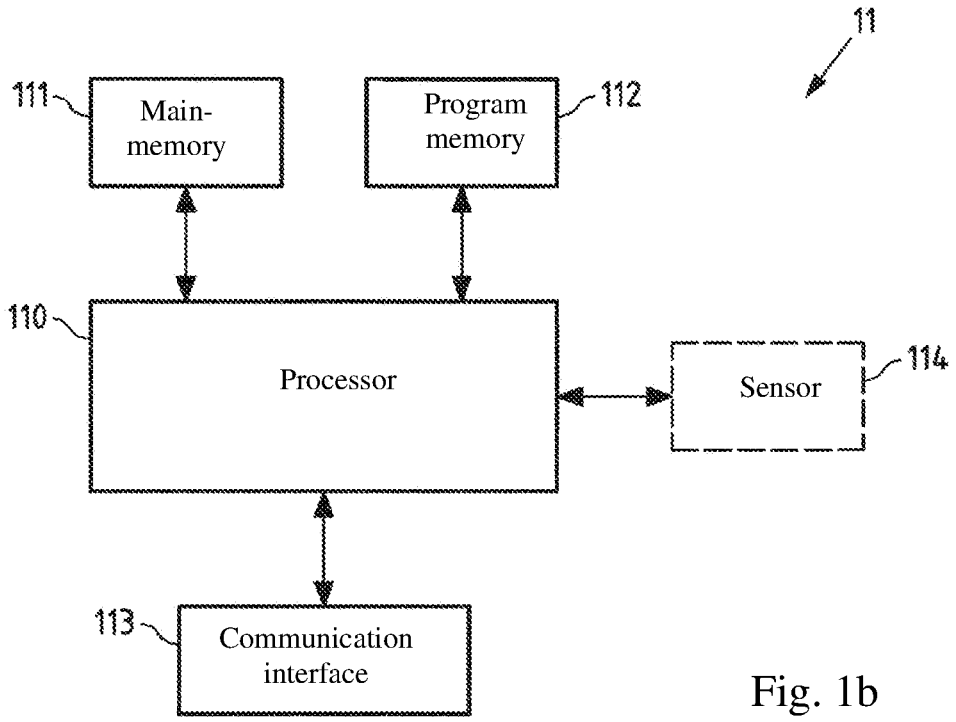
FIG. 1*b* is a block diagram of an example of the execution of a textile piece device according to the first aspect of the present disclosure.

FIG. 1*b* shows a block diagram of the textile piece device 11 according to the first aspect of the present disclosure. A textile piece device 11 comprising at least a processor 110, a main memory 111, a program memory 112, a communication interface 113 and a sensor 114.

A processor should be understood as a microprocessor, a microcontroller, a digital signal processor (DSP), an application specific integrated circuit (ASIC) or a field programmable gate array (FPGA). It goes without saying that the textile cutting device 11 can also include several processors 110.

Processor 110 executes program instructions stored in program memory 112 and stores, for example, intermediate results or the like in main memory 111. The program memory 112 contains, for example, program instructions of a computer program according to the first aspect of the present disclosure, comprising program instructions which cause the processor 110 to execute and/or control the method according to the first aspect of the present disclosure (e.g. the process according to the flow chart 200 shown in FIG. 2) when the processor 110 executes these program instructions stored in program memory 112. In addition, further information such as washing parameter information and/or textile piece information and/or information concerning properties of the textile piece such as composition, color, type of fabric may be stored in program memory 112.

Program memory 112 also contains, for example, the operating system of the textile piece device 11, which is at least partially loaded into main memory 111 when the textile piece device 11 is started and executed by the processor 110. In particular, when the textile piece device 11 is started, at least part of the core of the operating system is loaded into main memory 111 and executed by processor 110.

An example of an operating system is a Windows, UNIX, Linux, Android, Apple iOS and/or MAC OS operating system. The operating system allows in particular the use of the device for data processing. For example, it manages resources such as a main memory and a program memory, makes basic functions available to other computer programs through programming interfaces and controls the execution of computer programs.

For example, a program memory is a non-volatile memory such as a flash memory, a magnetic memory, an EEPROM memory (electrically erasable programmable read-only memory) and/or an optical memory. A main memory is, for example, a volatile or non-volatile memory, in particular a random access memory (RAM) such as a static RAM memory (SRAM), a dynamic RAM memory (DRAM), a ferroelectric RAM memory (FeRAM) and/or a magnetic RAM memory (MRAM).

Main memory 111 and program memory 112 can also be designed as one memory. Alternatively, main memory 111 and/or program memory 112 can each be formed by several memories. Furthermore, main memory 111 and/or program memory 112 can also be part of processor 110.

Processor 110 controls the wireless communication interface 113, which is designed as a Bluetooth interface, WLAN interface, NFC interface and/or RFID interface, for example. In particular, the communication interface 113 is arranged to establish a wireless communication link between the textile piece device 11 and other devices and to communicate with these devices. A communication interface can, for example, receive information (via a wireless communication link such as communication links 13 and 14) and forward it to the processor and/or receive information from the processor and send it (via a wireless communication link such as communication links 13 and 14).

Furthermore, processor 110 can control at least one sensor 114. For example, sensor 114 is designed to detect and/or determine a value of a washing parameter before and/or during a washing cycle of textile piece 10. For example, sensor 114 is an acceleration sensor, a pressure sensor, a temperature sensor, an optical sensor and/or a chemical sensor (e.g. a pH sensor).

The components 110 to 114 of the textile cutting device are, for example, communicatively connected to each other via one or more bus systems (e.g. one or more serial and/or parallel bus connections).

It is understood that the textile piece device can include components 110 to 114 as well as other components (e.g. additional sensors).

Figure 1C:
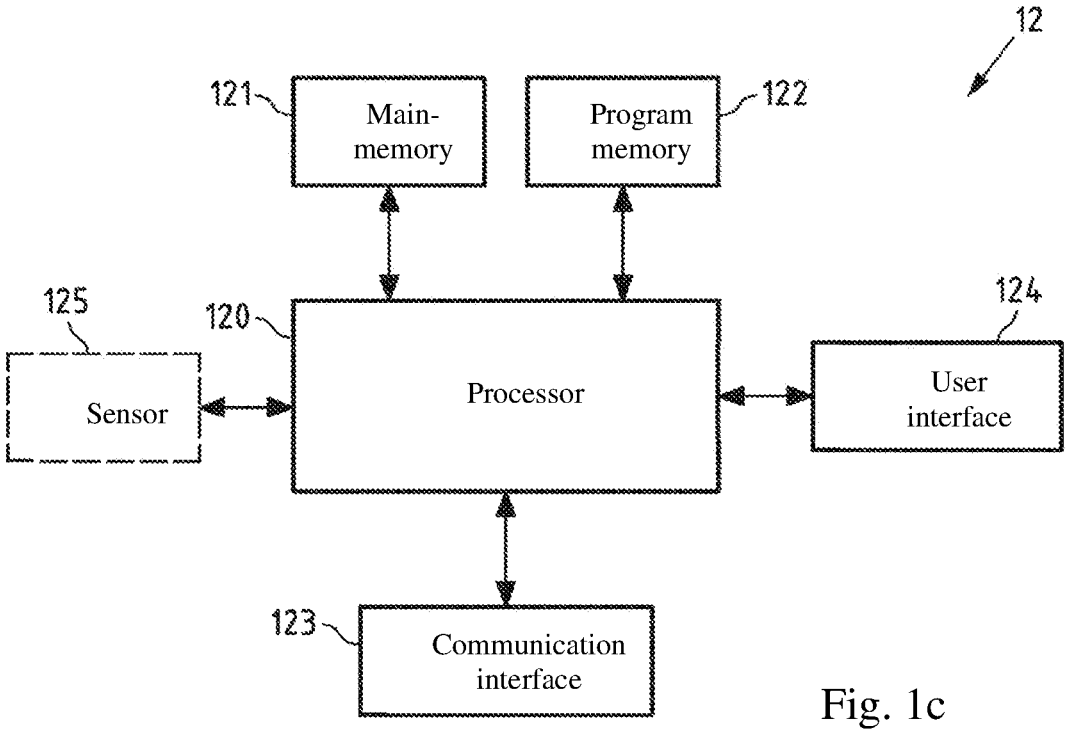
FIG. 1*c* is a block diagram of an example of the execution of a device according to the second aspect of the present disclosure.

FIG. 1*c* shows a block diagram of device 12 according to the second aspect of the present disclosure. Device 12 comprising at least a processor 120, a main memory 121, a program memory 122, a communication interface 123, and an optional user interface 124.

It is understood that device 12 can also include several processors 120.

Processor 120 executes program instructions stored in program memory 122 and stores, for example, intermediate results or the like in main memory 121. The program memory 122, for example, contains program instructions of a computer program according to the second aspect of the present disclosure, comprising program instructions which cause the processor 120 to execute and/or control the process according to the second aspect of the present disclosure (e.g. the process according to the flowchart 300 shown in FIG. 3) when the processor 120 executes these program instructions stored in program memory 122.

Program memory 122 further contains, for example, the operating system of device 12, which is at least partially loaded into main memory 121 when device 12 is started and executed by processor 120.

Main memory 121 and program memory 122 can also be designed as one memory. Alternatively, main memory 121 and/or program memory 122 can each be formed by several memories. Furthermore, main memory 121 and/or program memory 122 can also be part of processor 120.

Processor 120 controls the wireless communication interface 123, which is designed as a Bluetooth interface, WLAN interface, NFC interface and/or RFID interface, for example. The communication interface 123 is in particular arranged to establish a wireless communication connection (such as communication connections 13 and 14) of the device 12 with other devices and to communicate with them.

Furthermore processor 120 can control at least one user interface 124. Such a user interface may include, for example, one or more keys, a keyboard (e.g., alphanumeric keyboard or numeric keyboard such as a keypad), a touch screen (e.g., touch display), a microphone, and/or a camera. The user interface 124 can be used for communication with a user, e.g. for input and/or output of user information. For example, user interface 124 is the default user interface of device 12.

The components 120 to 124 of the textile piece device are, for example, communicatively connected to each other via one or more bus systems (e.g. one or more serial and/or parallel bus connections).

It is understood that the textile piece device can comprise 120 to 124 other components in addition to the components.

Figure 2A:
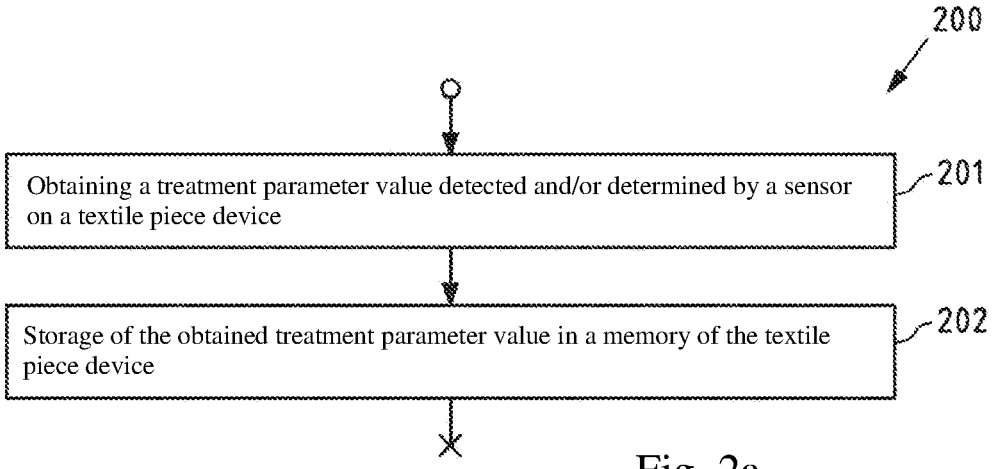
FIG. 2 is a flow chart of an example of the execution of a procedure according to the first aspect of the present disclosure.
Figure 2B:
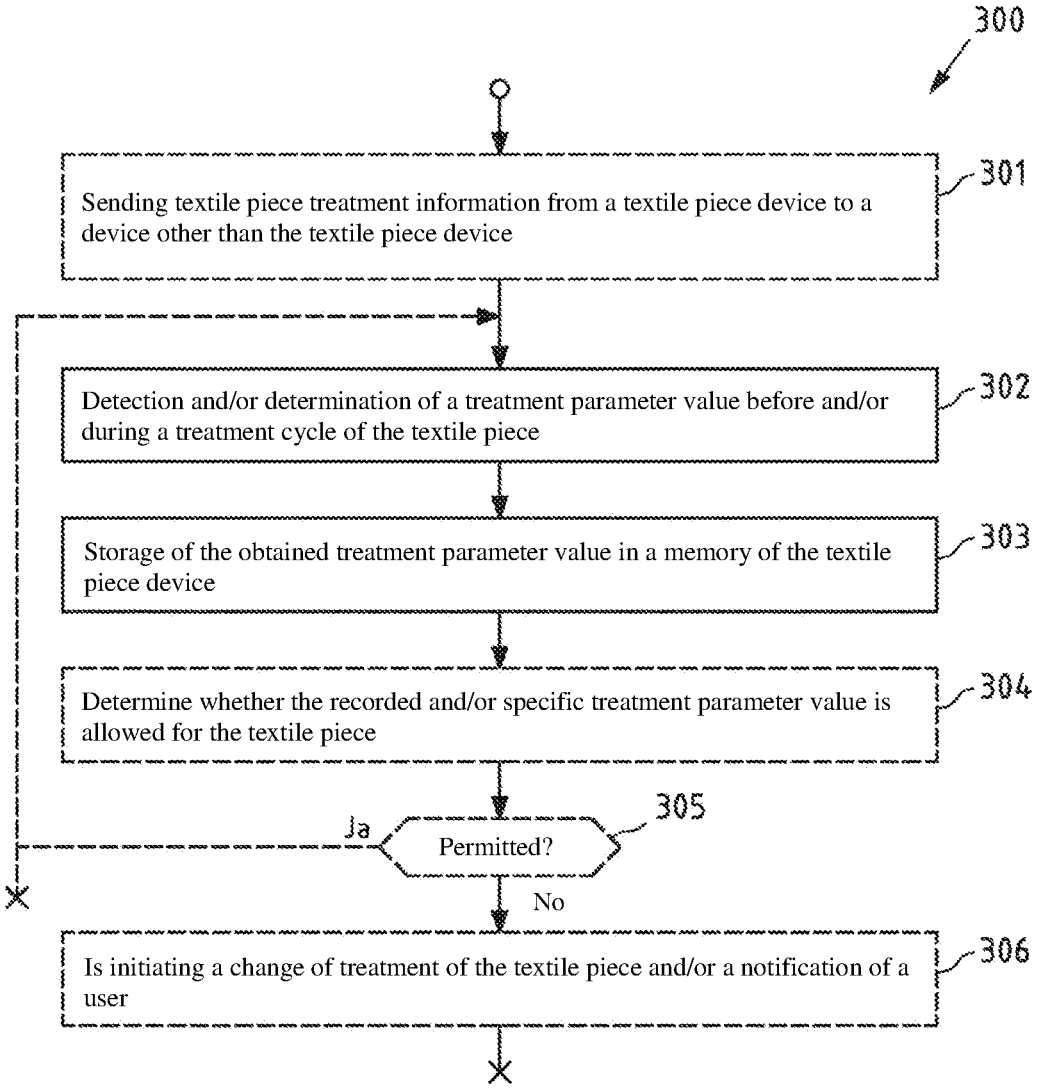

FIG. 2 shows a flowchart 200 of an execution example of a procedure according to the first aspect of the present disclosure. The following example assumes that steps 201 to 205 of the flowchart 200 are performed by the textile piece device 11 in system 1.

In an optional step 201, the textile piece device 11 sends textile piece treatment information to the device 12. For example, the textile piece information is stored in program memory 112 of the textile piece device 11.

The textile piece treatment information represents a permitted value and/or a permitted value range of a washing parameter for the textile piece. Such washing information can, for example, represent a permissible value (e.g. minimum or maximum) and/or a permissible value range of a washing parameter for the textile piece, with which the textile piece may be loaded permanently or for a certain period of time under practical conditions without damaging the textile.

As revealed above, the washing parameter is, for example, characteristic of a load on the textile piece during the washing cycle of the textile piece, for example, a mechanical and/or chemical load on the textile piece during the washing cycle of the textile piece. The load on the textile piece during washing in a washing machine depends, for example, on the washing program (e.g. washing temperature, washing time, water level, spin speed, etc.), the detergent and its dosage, the loading of the washing drum and the other textile pieces. Examples of washing parameters include temperature, acceleration, color, white content, contrast, chemical composition, dosage, pH and/or duration. For example, the textile treatment information represents a permitted (e.g. minimum and/or maximum) value and/or range of values of such a wash parameter for the textile during a wash cycle.

For example, the textile piece treatment information represents a maximum temperature value (e.g. about 30° C., about 40° C., about 60° C. or about 95° C.) of the wash liquor with which the textile piece may be washed. Alternatively, the textile piece treatment information may represent a maximum value for the acceleration or pressure that may be applied to the textile piece during the wash cycle. This maximum acceleration or pressure value can, for example, correspond to the expected acceleration or pressure when spinning the textile piece at the maximum permissible spinning speed (e.g. about 60 rpm, about 600 rpm, about 1,200 rpm or about 1,600 rpm). For example, the textile piece treatment information represents a color range of the wash liquor and/or other textile pieces with which the textile piece may be washed.

It is understood that also several textile piece treatment information, representing for example a washing and/or care instruction for the textile piece, can be sent to device 12 in step 201.

This is advantageous, for example, so that device 12 can determine a washing programme and/or a drying programme permissible for the textile piece (e.g. a washing and/or drying programme in which the value and/or range of values permissible for the textile piece of one or more washing parameters are not exceeded) and/or prevent an impermissible washing programme and/or an impermissible drying programme from being started.

In a step 202, the textile piece device 11 detects and/or determines a value of the washing parameter before and/or during a washing cycle of the textile piece. For example, the value of the washing parameter is measured by the sensor 114 of the textile piece device 11 in step 202.

Optionally, washing parameter information representing the value of the washing parameter detected and/or determined in step 202 may be stored in program memory 112 and/or sent to device 12.

In an optional step 203, the textile piece device 11 determines whether the value of the washing parameter detected and/or determined in step 202 is acceptable for the textile piece. For this purpose, the recorded and/or specific value of the washing parameter can be compared, for example, with a permitted value and/or range of values of the washing parameter for the textile piece (e.g. minimum or maximum) represented by textile piece treatment information.

For example, if the determination in step 203 indicates that the detected and/or determined value of the wash parameter is acceptable for the textile piece, the flowchart in step 202 is terminated or jumps to step 202, for example. Otherwise, the flowchart continues with an optional step 205.

In the optional step 205, the textile piece device 11 causes a change in the value of the washing parameter and/or a notification of a user. For example, causing the textile piece device to send washing parameter change information to device 12 in step 205 is to be understood as causing the textile piece device to do so. If the device 12 is a washing machine, the washing parameter change information causes the washing machine, for example, to adjust or interrupt a running washing program so that the value of the washing parameter changes (e.g. the value of the washing parameter changes to an allowable value due to the adjustment). Alternatively or additionally, the wash parameter change information may, for example, cause a user to be notified by the user interface 124 of device 12 in order to alert the user to the invalid value and/or cause the user to manually change the value.

Figure 3:
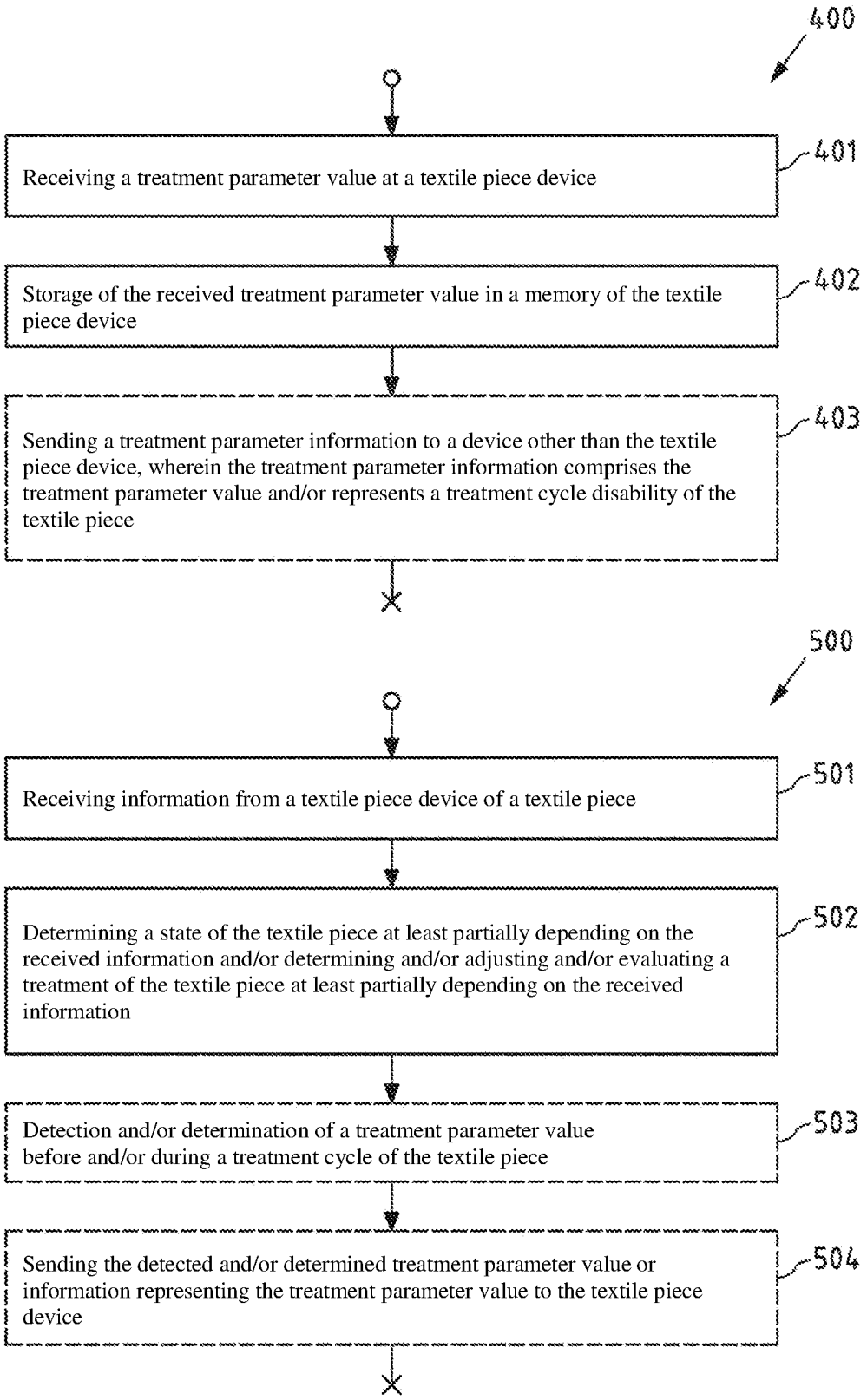
FIG. 3 is a flowchart of an execution example of a procedure according to the second aspect of the present disclosure.

FIG. 3 shows a flowchart 300 of an execution example of a procedure according to the second aspect of the present disclosure. The following example assumes that steps 301 to 302 of the flowchart 300 are performed by device 12 in system 1.

In a step 301, the device 12 receives information from the textile piece device 11.

For example, the device 12 in step 301 receives the textile piece treatment information(s) sent in step 201. Alternatively or additionally, the device 12 in step 301 receives, for example, washing parameter change information sent in step 205.

In a step 302, the device 12 determines a program for a washing cycle for the textile piece at least partially depending on the received information and/or adapts a program for a washing cycle for the textile piece at least partially depending on the received information.

For example, determining a program for a washing cycle for the textile piece determining a permissible washing program for the textile piece that does not exceed a value and/or value range of a washing parameter that is permissible for the textile piece. This allowed value and/or allowed value range is represented, for example, by textile piece information received in step 301. It is understood that several textile piece information received in step 301 can also be taken into account in step 302.

For example, if device 12 is a washing machine, device 12 may prevent the user from starting a washing program which is not allowed for the textile piece and/or automatically selecting and/or starting a washing programme which is allowed for the textile piece. On the other hand, if the device 12 is a smartphone, the device 12 can communicate to the user through the user interface 124 (e.g. display on a screen) the washing program and the associated washing parameters determined as permissible for the textile piece.

Adjusting a program for a wash cycle for the piece of fabric, for example, can be done based on a wash parameter change information received in step 301. For example, if device 12 is a washing machine, device 12 can adjust a running washing program so that the value of the washing parameter changes to a permissible value due to the adjustment (e.g. by adjusting the washing temperature or spin speed). This may include, for example, interrupting and/or stopping the wash programme.

Some of the advantages and exemplary applications of the present disclosure are further explained below by employing examples. However, the present disclosure is not limited to these examples and use cases.

Example: Textile Piece Made of Wool:

In general, it is not recommended to expose woollen items to higher temperatures and, in particular, stronger mechanical effects in a washing cycle. A textile piece device for a textile piece made of wool could therefore, for example, contain at least one acceleration sensor and/or one temperature sensor. Furthermore, a program memory of the textile piece device could contain corresponding textile piece treatment information with information on maximum acceleration and maximum temperature.

For example, the textile piece device is connected to a washing machine and/or smartphone via a wireless communication link and sends the textile piece treatment information to the washing machine and/or smartphone (see step 201). This enables the textile piece device to proactively prevent, for example, a user from selecting a washing program with an impermissible load (e.g. an impermissible mechanical load). Instead, the user is guided, for example, to an optimal program adapted to the textile properties.

Alternatively or additionally, during the washing cycle in the machine, for example, the textile piece device on the textile can determine that a washing program with an impermissible mechanical load has been selected (see steps 202 and 203). In this case, for example, the textile piece device may inform and/or cause the user to be informed (see step 205) and request manual (remote) intervention, for example. Alternatively or additionally, the textile piece device can, for example, stop the washing program immediately or initiate such a stop (see step 205) in order to protect the piece of laundry from harmful effects. The textile piece device can carry out these activities, for example, independently of the accompanying remaining load of textile pieces.

Example of a Colored Textile Piece:

It is recommended to separate colored textile pieces from white textile pieces, because the bleaching of colored textile pieces and the transfer of the dye from the washing liquor to other textile pieces can discolor them. The lower the washing temperature, the lower the effect. Therefore, the textile piece device of a colored textile piece could, for example, contain at least one optical sensor to detect the ambient color both in the dry and in the wet state. This sensor could, for example, be set up to determine the white content of its textile environment. In addition, a programme memory of the textile piece device could contain corresponding textile piece treatment information with information on permissible colors of other textile pieces which may be washed together with the textile piece.

For example, the textile piece device is connected to a washing machine and/or a smartphone via a wireless communication link and prevents, for example, the user from being able to start a program with strongly color-differentiating textiles. For example, it prevents the textile that tends to bleed from damaging other textiles.

Alternatively or additionally, by measuring the ambient color or the change in the color of the liquor in the machine, the textile piece device can determine whether the textile piece is actually bleaching (see steps 202 and 203). If this is the case, the textile piece device, as described above, can, for example, inform the user and/or cause the user to be informed (see step 205) and, for example, request manual (remote) intervention. Alternatively or additionally, the textile piece device can, for example, stop the washing program immediately or initiate such a stop (see step 205) in order to protect the piece of laundry from harmful effects. The textile piece device can also carry out these activities, for example, independently of the accompanying remaining load of textile pieces.

Example: Interaction of Different Sensors:

It can happen that several textile pieces with one textile piece device are on the move in one wash load. In this case it can be advantageous if the textile piece devices can communicate and exchange the available information (e.g. textile piece treatment information, washing parameter information, etc.). Among other things, the following possibilities can be considered:

a. For example, the textile piece devices form an autonomous mesh network and negotiate the prioritized information among themselves on the basis of a priority list.
b. The textile sensors communicate their information, for example, to a central decision point, which determines the prioritized information automatically or by user intervention.
c. The user can determine beforehand which textile cutting device assumes the guiding function.

For example, all other textile piece devices are subordinate, can optionally continue to record and/or determine washing parameters or switch to sleep mode.

Example of Data Collection and Utilization:

The repeated recording, storage, targeted analysis and derivation of knowledge, including future knowledge, from the information obtained is an additional added value which is added to the mere protection of textile pieces from harmful influences. This enables the user, for example, to create a textile or washing history for the first time. For example, he can see the age, the washing frequency, the detergent used and can see the state of preservation of the textile at each stage. The assignment of the degree of conservation can be done manually using a point system (e.g. in an app). The user can draw conclusions as to whether the washing process used or the detergent has a positive or negative effect on the degree of preservation of the textile. If the user allows it, the information can also be transferred to the medium manufacturer, for example, so that he is able to analyze and optimize the washing and care effect of his products by combining a lot of data.

Figure 4:
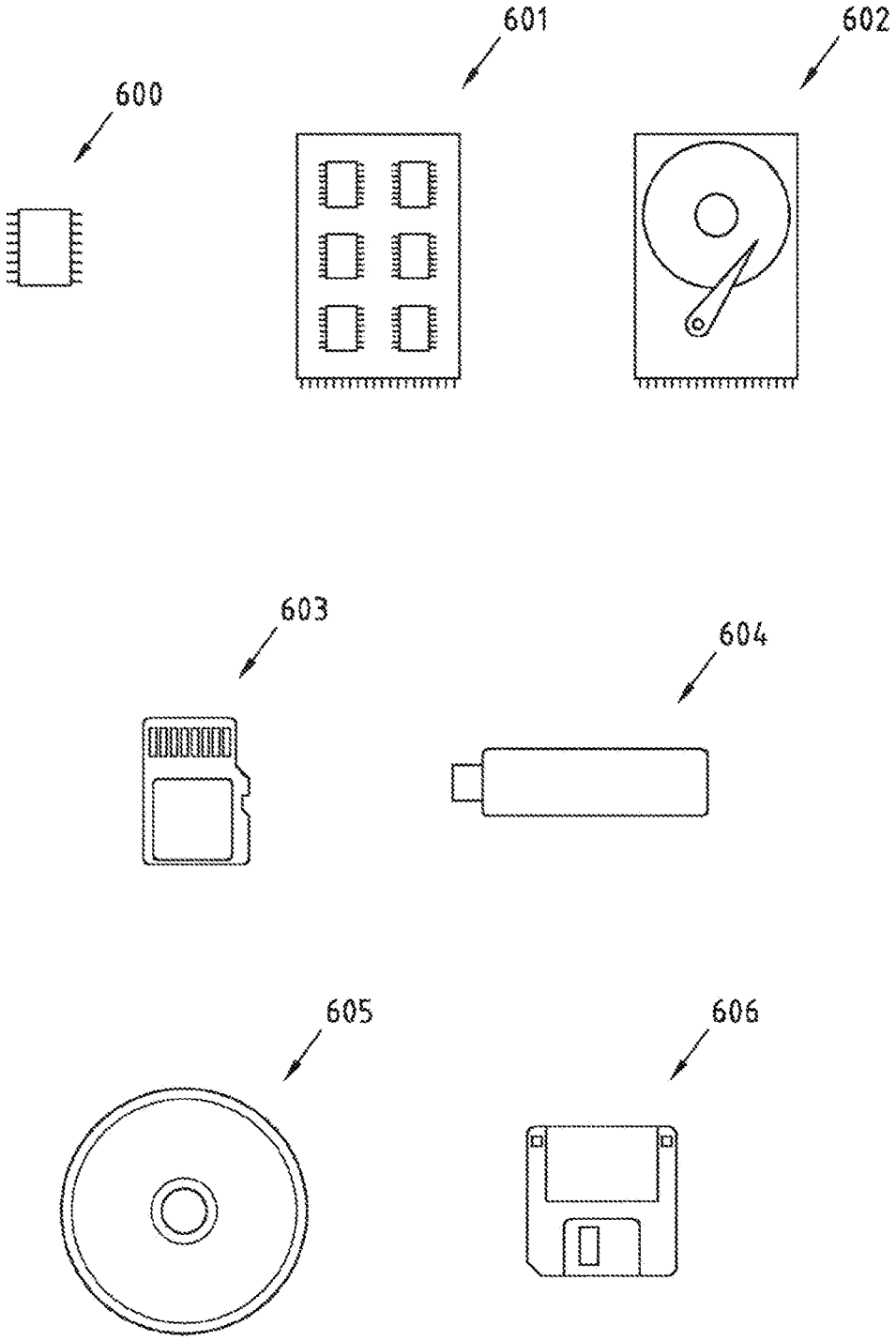
FIG. 4 shows different execution examples of a storage medium.

FIG. 4 finally shows different examples of the execution of storage media on which an example of the execution of a computer program as contemplated herein can be stored. The memory medium may for example be a magnetic, electrical, optical and/or different memory medium. The storage medium may, for example, be part of a processor (e.g. the processor 110 of the textile piece device 11), for example a (non-volatile or volatile) program memory of the processor or a part thereof (such as program memory 112 of the textile piece device 11). Examples of a storage medium are a flash memory 410, an SSD hard disk 411, a magnetic hard disk 412, a memory card 413, a memory stick 414 (e.g. a USB stick), a CD-ROM or DVD 415 or a floppy disk 416.

The examples of execution of the present disclosure described in this specification and the optional features and characteristics listed in each case shall also be understood in all combinations with each other. In particular, the description of a feature covered by an execution example—unless explicitly stated otherwise—should not be understood to mean that the feature is indispensable or essential for the function of the execution example. The sequence of the process steps described in this specification in the individual flow diagrams is not mandatory, alternative sequences of the process steps are conceivable. The process steps can be implemented in different ways, and therefore implementation in software (by employing program instructions), hardware, or a combination of both are conceivable for implementing the method steps.

Terms used in the patent claims such as "include", "comprise", "contain" and the like do not exclude additional elements or steps. The wording "at least in part" covers both "partly" and also "completely". The wording "and/or" is intended to be understood such that both the alternative and the combination are intended to be disclosed, i.e. "A and/or B" means "(A) or (B)" or "(A and B)". The use of the indefinite article does not exclude a plurality. A single device can carry out the functions of a plurality of units or devices mentioned in the patent claims. Reference signs stated in the patent claims should not be considered to limit the features and steps used.

The invention claimed is:

1. A method comprising:

During a treatment cycle to treat a textile piece:

Detecting a treatment parameter value at the textile piece by a textile piece device disposed on the textile piece, the treatment parameter value being detected by a sensor, the treatment parameter value being characteristic of a load on the textile piece during the treatment cycle, Storing the treatment parameter value in a memory of the textile piece device, Sending textile piece treatment information from the textile piece device to a device other than the textile piece device, wherein the textile piece treatment information is indicative of a permissible treatment parameter value and/or a permissible treatment parameter value range for the textile piece, Determining, by the textile piece device, whether the detected treatment parameter value is permissible for the textile piece based on the textile piece treatment information, and Causing a change of treatment of the textile piece and/or notification of a user, by the textile piece device, if the determining results in the treatment parameter value for the textile piece being inadmissible.

2. The method according to claim 1, wherein the sensor is part of the textile piece device.

3. The method according to claim 1, wherein the sensor is part of the device other than the textile piece device.

4. The method according to claim 1, wherein the treatment parameter value is indicative of a temperature, a treatment duration, an acceleration, a pressure, a vibration, an electromagnetic field, an electromagnetic radiation, a sound frequency, a sound pressure level, a pH value, a conductivity, a redox potential, an odor, an ozone concentration, a NOX concentration, an SO2 concentration, a color, a white fraction, a germ load, a location, a humidity, an air pressure, a wind speed, a wind direction, a light intensity, a Rayleigh scattering and/or a dust concentration.

5. The method according to claim 1, the method further comprising:

Sending treatment parameter information to the device other than the textile piece device, the treatment parameter information comprising the treatment parameter value and/or representing a treatment cycle history of the textile piece.

6. The method of claim 1, wherein the sensor comprises one or more of an accelerometer, a temperature sensor, an optical sensor, a conductivity sensor, and a chemical sensor.

7. The method of claim 1, wherein the textile piece device is disposed within a label of the textile piece.

8. The method of claim 1, wherein the device other than the textile piece device is a laundering device.

9. The method of claim 8, wherein the laundering device is a washing machine and/or a dryer.

10. The method of claim 1, wherein the device other than the textile piece device is a handheld electronic device.

11. The method of claim 1, wherein the textile piece device is part of an autonomous mesh network with a plurality of other textile piece devices.

12. The method of claim 11, further comprising:

negotiating a prioritization of each of the textile piece devices in the autonomous mesh network.

* * * * *